US006855216B2

(12) United States Patent
Kikuchi et al.

(10) Patent No.: US 6,855,216 B2
(45) Date of Patent: Feb. 15, 2005

(54) METHOD OF PROCESSING AND HEAT-TREATING NBC-ADDED FE-MN-SI-BASED SHAPE MEMORY ALLOY

(75) Inventors: Takehiko Kikuchi, Ibaraki (JP); Setsuo Kajiwara, Ibaraki (JP); Alberto Baruj, Ibaraki (JP); Kazuyuki Ogawa, Ibaraki (JP); Norio Shinya, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 92 days.

(21) Appl. No.: 10/391,659

(22) Filed: Mar. 20, 2003

(65) Prior Publication Data

US 2004/0007293 A1 Jan. 15, 2004

(30) Foreign Application Priority Data

Mar. 20, 2002 (JP) ..... 2002-079295

(51) Int. Cl.[7] ..... C21D 8/00
(52) U.S. Cl. ..... 148/563; 148/653
(58) Field of Search ..... 148/563, 653

(56) References Cited

U.S. PATENT DOCUMENTS 5,198,041 A * 3/1993 Takemoto et al. ..... 148/402
5,380,483 A * 1/1995 Watanabe et al. ..... 420/73
6,524,406 B2 * 2/2003 Kikuchi et al. ..... 148/402

FOREIGN PATENT DOCUMENTS

EP 1348772 A1 * 10/2003
JP 2003/105438 A * 4/2003

* cited by examiner

*Primary Examiner*—George Wyszomierski
(74) *Attorney, Agent, or Firm*—Wenderoth, Lind & Ponack, L.L.P.

(57) ABSTRACT

A NbC-added Fe—Mn—Si-based shape memory alloy is provided, showing a shape memory property even if a special treatment such as training is not performed.

A Fe—Mn—Si-based shape memory alloy containing Nb and C is rolled by 10 to 30% in a temperature range of 500 to 800° C. under austenite condition, then, subjected to an aging treatment by heating in a temperature range of 400 to 1000° C. for 1 minute to 2 hours.

13 Claims, 2 Drawing Sheets

METHOD OF PROCESSING AND HEAT-TREATING NBC-ADDED FE-MN-SI-BASED SHAPE MEMORY ALLOY

FIELD OF THE INVENTION

The invention of the present application relates to a method of processing and heat-treating a NbC-added Fe—Mn—Si-based shape memory alloy. More particularly, the invention of the present application relates to a method of processing and heat-treating a NbC-added Fe—Mn—Si-based shape memory alloy, capable of further enhancing the shape memory property of a NbC-added Fe—Mn—Si-based shape memory alloy showing an excellent shape memory property even without training.

PRIOR ART

An Fe—Mn—Si-based shape memory alloy was invented for the first time in Japan in early 1980s, and the prime reason for non-wide spread of this alloy is that this alloy does not show a sufficient shape memory alloy effect unless a special processing and heating treatment called training is applied. Training means that a procedure of deformation of 2 to 3% at room temperature, then, heating to around 600° C. above the reverse transformation temperature is repeated several times. Very recently, we have found that, by adding Nb and C elements in small amount to an Fe—Mn—Si-based shape memory alloy and making a suitable aging heating treatment to precipitate fine NbC carbides, a sufficiently excellent shape memory effect is shown without training and filed an application of this invention (Japanese Patent Application No. 2000-32478). In addition, we applied for an invention (Japanese Patent Application No. 2001-296901) of NbC-added F Fe—Mn—Si-based shape memory alloy, which renews upon aging if processed with austenite. The invention of the present application intends to further improve these inventions of prior applications. Namely, it is intended to enhance the rolling effect on the shape memory property by variously changing the rolling ratio of NbC-added Fe—Mn—Si-based shape memory alloys.

DISCLOSURE OF THE INVENTION

The inventors of the present application have intensively studied further improvement of the shape memory property of a NbC-added Fe—Mn—Si-based shape memory alloy filed previously, and found that shape recovery ratio and shape recovery force are improved at any amount of deformation if an alloy after melting is subjected to rolling of 10 to 30% in a temperature range of 500 to 800° C. under austenite condition before conducting an aging treatment by heating in a temperature range of 400 to 1000° C. for 1 minute to 2 hours to precipitate NbC. Namely, the invention of the present application provides, firstly, a method of processing and heat-treating a NbC-added Fe—Mn—Si-based shape memory alloy, wherein a Fe—Mn—Si-based shape memory alloy containing Nb and C added is rolling-processed by 10 to 30% in a temperature range of 500 to 800° C. under austenite condition, then, subjected to an aging treatment by heating in a temperature range of 400 to 1000° C. for 1 minute to 2 hours, and secondly, the method of processing and heat-treating a NbC-added Fe—Mn—Si-based shape memory alloy according to the above-mentioned method, wherein the Fe—Mn—Si-based shape memory alloy contains, as alloy components, Mn in an amount of 15 to 40% by weight, Si in an amount of 3 to 15% by weight, Nb in an amount of 0.1 to 1.5% by weight and C in an amount of 0.01 to 0.2% by weight, the residues is composed of Fe and unavoidable impurities, and the atomic ratio Nb/C of Nb to C is 1 or more, further, the invention of the present application provide, thirdly, the method of processing and heat-treating a NbC-added Fe—Mn—Si-based shape memory alloy according to claim 1, wherein the NbC-added Fe—Mn—Si-based shape memory alloy contains, as alloy components, Mn in an amount of 5 to 40% by weight, Si in an amount of 3 to 15% by weight, Cr in an amount of 1 to 20% by weight, Nb in an amount of 0.1 to 1.5% by weight and C in an amount of 0.01 to 0.2% by weight, the residues is composed of Fe and unavoidable impurities, and the atomic ratio Nb/C of Nb to C is 1 or more. Further, the invention of the present application provide, fourthly, the method of processing and heat-treating a NbC-added Fe—Mn—Si-based shape memory alloy according to claim 1, wherein the NbC-added Fe—Mn—Si-based shape memory alloy contains, as alloy components, Mn in an amount of 5 to 40% by weight, Si in an amount of 3 to 15% by weight, Cr in an amount of 1 to 20% by weight, Ni in an amount of 0.1 to 20% by weight, Nb in an amount of 0.1 to 1.5% by weight and C in an amount of 0.01 to 0.2% by weight, the residues is composed of Fe and unavoidable impurities, and the atomic ratio Nb/C of Nb to C is 1 or more, and fifthly, the method of processing and heat-treating a NbC-added Fe—Mn—Si-based shape memory alloy according to any one of claims 2 to 4, wherein the atomic ratio of Nb to C is 1.0 or more. The invention of the present application provides, sixthly, the method of processing and heat-treating a NbC-added Fe—Mn—Si-based shape memory alloy according to any one of claims 2 to 5, wherein the NbC-added Fe—Mn—Si-based shape memory alloy contains, as impurity components, at least one or more of Cu in an amount of 3% by weight or less, Mo in an amount of 2% by weight or less, Al in an amount of 10% by weight or less, Co in an amount of 30% by weight or less or N in an amount of 5000 ppm or less.

DETAILED DESCRIPTION OF THE INVENTION

The invention of the present application improves remarkably a shape memory property by specifying a rolling ratio in the range of 10 to 30%, and shape memory alloy materials used in the present invention have the following chemical compositions (% by weight).

<Fe—Mn—Si>
Mn: 15 to 40
Si: 3 to 15
Nb: 0.1 to 1.5
C: 0.01 to 0.2
Fe: residual amount
<Fe—Mn—Si—Cr>
Mn: 5 to 40
Si: 3 to 15
Cr: 1 to 20
Nb: 0.1 to 1.5
C: 0.01 to 0.2
Fe: residual amount
<Fe—Mn—Si—Cr—Ni>
Mn: 5 to 40
Si: 3 to 15
Cr: 1 to 20

Ni: 0.1 to 20
Nb: 0.1 to 1.5
C: 0.01 to 0.2
Fe: residual amount

It is necessary that, in any of the above-mentioned alloys, the atomic ratio Nb/C of niobium to carbon is 1 or more, more preferably 1.0 to 1.2. Further considered as impurities are Cu: ≦3
Mo: ≦2
Al: ≦10
Co: ≦30
N: ≦5000 (ppm), and the like. Of course, also in any of the methods of the present application, mixing of unavoidable impurities is permitted.

In the method of processing and heat-treating a NbC-added Fe—Mn—Si-based shape memory alloy according to the invention of the present application, as described above, an Fe—Mn—Si-based shape memory alloy containing Nb and C is rolled by 10 to 30% in a temperature range of 500 to 800° C. under austenite condition, then, subjected to an aging treatment by heating in a temperature range of 400 to 1000° C. for 1 minute to 2 hours. Shape recovery ratio is improved at any amount of deformation if an alloy after melting is subjected to rolling of 10 to 30% in a temperature range of 600 to 800° C. under austenite condition (so called, hot processing) before conducting an aging treatment by heating in a temperature range of 400 to 1000° C. for 1 minute to 2 hours to precipitate NbC. Though the amount of deformation required practically is about 4%, the invention of the present application shows a sufficiently excellent shape recovery ratio even with larger amount of deformation than this, and can be used as a practical alloy. With this improvement, shape recovery force also increases. Shape recovery force is one of the important shape memory properties for practical use.

In the method of processing and heat-treating a NbC-added Fe—Mn—Si-based shape memory alloy according to the invention of the present application, the reason for limitation of the temperature range in rolling-process before the above-mentioned aging treatment to 500 to 800° C. is that when lower than 500° C., stress-induced martensite occurs, and when higher than 800° C., dynamic re-crystallization occurs, being ineffective for improvement of shape memory property.

Figure 1:
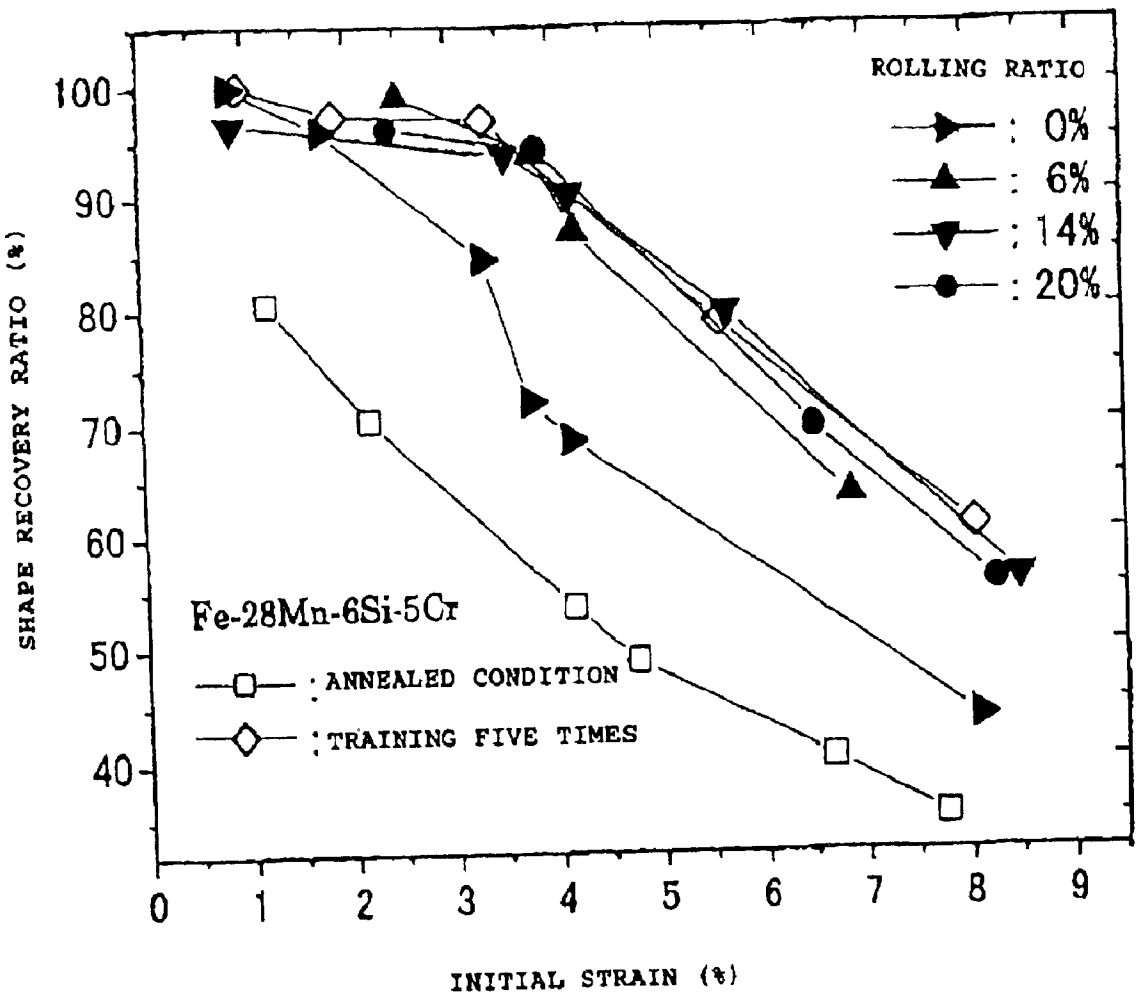
FIG. 1 shows a comparison of shape recovery ratio.
Figure 2:
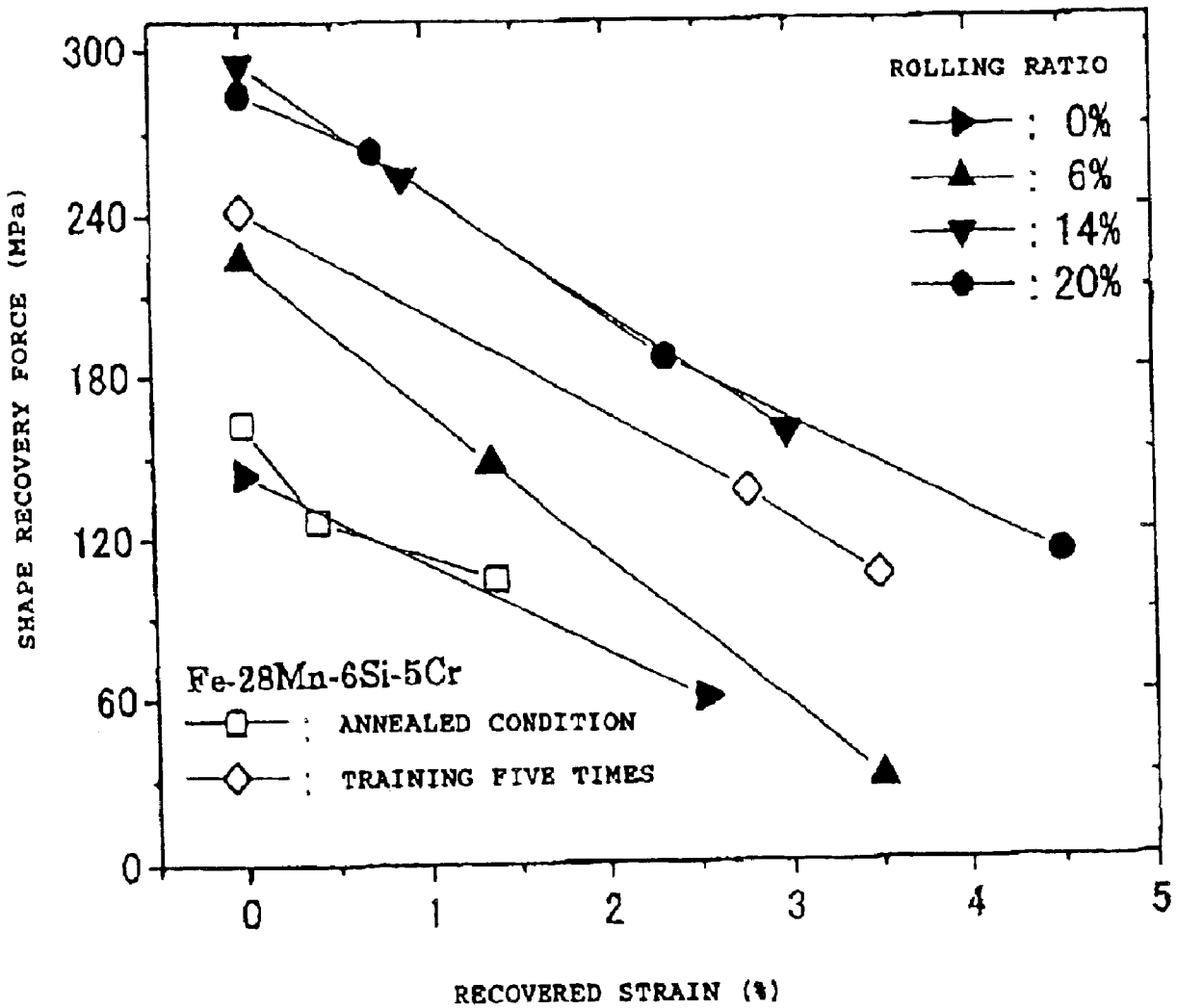
FIG. 2 shows a comparison of shape recovery force.

The effect of invention of the present application is clear as understood also from the same shape recovery ratio and the same or more shape recovery force as compared with those the conventional alloys in the cases including training five times, as shown in FIGS. 1 and 2, by limiting the rolling ratio to 10 to 30%.

In the method of processing and heat-treating a NbC-added Fe—Mn—Si-based shape memory alloy of the invention of the present application, the temperature range of the aging treatment conducted after the above-mentioned rolling processing is set lower than the temperature range in the invention of the above-mentioned patent application. The reason for this is ascribed to accumulation of strain in the parent phase by rolling before aging treatment.

EXAMPLE

The invention of the present application will be illustrated further in detail referring to FIGS 1 and 2. First, how a shape memory property is improved for a Fe—Mn—Si-based shape memory alloy containing Nb and C by 10–30% rolling in a temperature range of 500 to 800° C. under austenite condition, then, subjecting it to an aging treatment in a temperature range of 400 to 1000° C. for 1 minute to 2 hours, is shown below.

FIG. 1 is a graph showing difference in shape recovery ratio between the case in which only aging is conducted (0% rolling) and the case in which aging is conducted after rolling by 6%, 14% and 20% at 600° C. Aging was conducted always at 800° C. for 10 minutes. For comparison, results of samples of the Fe-28Mn-6Si-5Cr alloy containing no NbC prepared only by annealing and samples of the alloy prepared after training five times are shown. The abscissa shows strain by tensile deformation at room temperature, and the ordinate shows a shape recovery ratio of elongation when the sample is heated to 600° C. Also heated at 400° C., approximately the same shape recovery ratio is obtained. The samples used have a thickness of 0.6 mm, a width of 1 to 4 mm and a length (gage length) of 15 mm. As is known from this figure, the samples rolled by 14% and 20% have shape memory recovery ratio nearly equivalent to that of the alloy containing no NbC which was subjected to training five times.

As is known from FIG. 1, in the case of rolling by 6% corresponding to the example shown in the prior application (Japanese Patent Application No. 2001-296901), the result is somewhat inferior to that of the trained samples in the large strain range. Practically necessary amount of deformation is believed to be about 4%. A shape memory recovery ratio of 90% shown also at this deformation suggests strongly that it can be used as a practically applicable alloy even at rolling by 6%. Training of at least five times is necessary for obtaining the same shape recovery ratio as this, with a conventional Fe—Mn—Si-based shape memory alloy containing no NbC. Shape recovery force is one of the important shape memory properties for practical use, and FIG. 2 shows the shape recovery forces of samples aged after rolling by 14% and 20%, in comparison with the shape recovery forces when samples were only aged and when samples were aged after rolling by 6%. Recovered strain on the abscissa means strain permitted until heating samples manifests recovery force. For example, it can be recognized as equivalent to that represented by the ratio (%) of extent of clearance between a pipe and a coupling part (shape memory alloy) permitted when used as a coupling part to its diameter. The recovery force when recovered strain is zero is the stress when a sample is tensile-deformed at room temperature, then, heated to the reverse transformation temperature (400° C.) or more while fixing both sample ends, and returned to room temperature again, and the recovery force at recovered strain of 3%, for example, is the stress generated while fixing both ends after a recovery of strain by 3%. The initial strain given at room temperature is 4 to 6%. The shape of the test piece is the same as that used for obtaining the results shown in FIG. 1. As is known from the results of this figure, remarkable increase in shape recovery force is observed in the case of high rolling ratio (14%, 20%) as compared with cases of a rolling ratio of 0% (the case in which aging is only performed) and a rolling ratio of 6%.

Noticeably, it shows much larger recovery force than an alloy containing no NbC, which was subjected to training. It is also noticeable that fairy large shape recovery force is shown even at larger recovered stain.

Thus, it has been found that the invention of the present application shows a remarkably improved shape recovery property by limiting rolling ratio to 10 to 30%, as compared with the inventions of the prior applications, therefore, a patent application of the invention has been filed.

EFFECT OF THE INVENTION

As described in detail above, according to the invention of the present application, it is not necessary to perform such a complicated processing and heating treatment as training, and only by hot rolling and a subsequent aging treatment, a shape memory property can be remarkably improved easily. Differing from conventional alloy that requires a training treatment, it can be applied to alloy parts of any shape, and the like. For example, it can be used as coupling materials (of water supply tube, gas tube, petroleum transportation tube and the like), and the jointing by welding is not necessary, and possibilities of weakening and corrosion of welded parts occurring in welding can be avoided.

What is claimed is:

1. A method of processing and heat-treating a NbC-added Fe—Mn—Si-based shape memory alloy wherein an Fe—Mn—Si-based shape memory alloy containing Nb and C is rolling-processed by 10 to 30% in a temperature range of 500 to 800° C. under austenite condition, then, subjected to an aging treatment by heating in a temperature range of 400 to 1000° C.

2. The method of processing and heat-treating a NbC-added Fe—Mn—Si-based shape memory alloy according to claim 1, wherein the Fe—Mn—Si-based shape memory alloy contains, as alloy components, Mn in an amount of 15 to 40% by weight, Si in an amount of 3 to 15% by weight, Nb in an amount of 0.1 to 1.5% by weight and C in an amount of 0.01 to 0.2% by weight, the residues is composed of Fe and unavoidable impurities, and the atomic ratio Nb/C of Nb to C is 1 or more.

3. The method of processing and heat-treating a NbC-added Fe—Mn—Si-based shape memory alloy according to claim 2, wherein the atomic ratio of Nb to C is 1.0 to 1.2 or more.

4. The method of processing and heat-treating a NbC-added Fe—Mn—Si-based shape memory alloy according to claim 3, wherein the NbC-added Fe—Mn—Si-based shape memory alloy contains, as impurity components, at least one or more of Cu in an amount of 3% by weight or less, Mo is an amount of 2% by weight or less, Al in an amount of 10% by weight or less, Co in an amount of 30% by weight or less or N in an amount of 5000 ppm or less.

5. The method of processing and heat-treating a NbC-added Fe—Mn—Si-based shape memory alloy according to claim 2, wherein the NbC-added Fe—Mn—Si-based shape memory alloy contains, as impurity components, at least one or more of Cu in an amount of 3% by weight or less, Mo is an amount of 2% by weight or less, Al in an amount of 10% by weight or less, Co in an amount of 30% by weight or less or N in an amount of 5000 ppm or less.

6. The method of processing and heat-treating a NbC-added Fe—Mn—Si-based shape memory alloy according to claim 1, wherein the NbC-added Fe—Mn—Si-based shape memory alloy contains, as alloy components, Mn in an amount of 5 to 40% by weight, Si in an amount of 3 to 15% by weight, Cr in an amount of 1 to 20% by weight, Nb in an amount of 0.1 to 1.5% by weight and C in an amount of 0.01 to 0.2% by weight, the residues is composed of Fe and unavoidable impurities, and the atomic ratio Nb/C of Nb to C is 1 or more.

7. The method of processing and heat-treating a NbC-added Fe—Mn—Si-based shape memory alloy according to claim 6, wherein the atomic ratio of Nb to C is 1.0 to 1.2 or more.

8. The method of processing and heat-treating a NbC-added Fe—Mn—Si-based shape memory alloy according to claim 7, wherein the NbC-added Fe—Mn—Si-based shape memory alloy contains, as impurity components, at least one or more of Cu in an amount of 3% by weight or less, Mo is an amount of 2% by weight or less, Al in an amount of 10% by weight or less, Co in an amount of 30% by weight or less or N in an amount of 5000 ppm or less.

9. The method of processing and heat-treating a NbC-added Fe—Mn—Si-based shape memory alloy according to claim 6, wherein the NbC-added Fe—Mn—Si-based shape memory alloy contains, as impurity components, at least one or more of Cu in an amount of 3% by weight or less, Mo is an amount of 2% by weight or less, Al in an amount of 10% by weight or less, Co in an amount of 30% by weight or less or N in an amount of 5000 ppm or less.

10. The method of processing and heat-treating a NbC-added Fe—Mn—Si-based shape memory alloy according to claim 1, wherein the NbC-added Fe—Mn—Si-based shape memory alloy contains, as alloy components, Mn in an amount of 5 to 40% by weight, Si in an amount of 3 to 15% by weight, Cr in an amount of 1 to 20% by weight, Ni in an amount of 0.1 to 20% by weight, Nb in an amount of 0.1 to 1.5% by weight and C in an amount of 0.01 to 0.2% by weight, the residues is composed of Fe and unavoidable impurities, and the atomic ratio Nb/C of Nb to C is 1 or more.

11. The method of processing and heat-treating a NbC-added Fe—Mn—Si-based shape memory alloy according to claim 10, wherein the atomic ratio of Nb to C is 1.0 to 1.2 or more.

12. The method of processing and heat-treating a NbC-added Fe—Mn—Si-based shape memory alloy according to claim 11, wherein the NbC-added Fe—Mn—Si-based shape memory alloy contains, as impurity components, at least one or more of Cu in an amount of 3% by weight or less, Mo is an amount of 2% by weight or less, Al in an amount of 10% by weight or less, Co in an amount of 30% by weight or less or N in an amount of 5000 ppm or less.

13. The method of processing and heat-treating a NbC-added Fe—Mn—Si-based shape memory alloy according to claim 10, wherein the NbC-added Fe—Mn—Si-based shape memory alloy contains, as impurity components, at least one or more of Cu in an amount of 3% by weight or less, Mo is an amount of 2% by weight or less, Al in an amount of 10% by weight or less, Co in an amount of 30% by weight or less or N in an amount of 5000 ppm or less.

* * * * *